United States Patent [19]

Wirges et al.

[11] 4,072,288

[45] Feb. 7, 1978

[54] CHAIR WITH PNEUMATICALLY ADJUSTABLE SEAT HEIGHT AND BACK SUPPORT INCLINATION

[75] Inventors: Winfried Wirges, Koblenz-Moselweiss; Herbert Freitag, Koblenz-Metternich, both of Germany

[73] Assignee: Stabilus GmbH, Koblenz-Neuendorf, Germany

[21] Appl. No.: 686,738

[22] Filed: May 17, 1976

[30] Foreign Application Priority Data

June 10, 1975 Germany ..... 2525752

[51] Int. Cl.[2] ..... A47C 7/40

[52] U.S. Cl. ..... 248/404; 188/300; 248/354 H; 297/326; 297/355; 267/127

[58] Field of Search ..... 248/400, 404, 161, 354 H; 297/345, 347, 326, 355; 188/300, 322; 267/65 R; 254/93 R

[56] References Cited

U.S. PATENT DOCUMENTS

| | | | |
|---|---|---|---|
| 3,436,048 | 4/1969 | Green | 248/404 |
| 3,735,958 | 5/1973 | Hollingsworth | 254/93 R |
| 3,756,654 | 9/1973 | Bauer | 297/345 |
| 3,837,704 | 9/1974 | Bauer | 297/345 |
| 3,880,465 | 4/1975 | Scheben | 297/345 |

FOREIGN PATENT DOCUMENTS

| | | | |
|---|---|---|---|
| 875,837 | 7/1942 | France | 254/93 R |
| 2,256,188 | 5/1973 | Germany | 254/93 R |
| 38,562 | 12/1970 | Japan | 254/93 R |

*Primary Examiner*—Marion Parsons, Jr.
*Attorney, Agent, or Firm*—Hans Berman

[57] ABSTRACT

The height of a chair and the inclination of its back support may be varied by changing the respective, effective lengths of two pneumatic springs whose assembly forms the chair leg. The cylinder of one spring is coaxially received in the cylinder or the hollow piston rod of the other spring, and relative axial movement of the received spring and the receiving element of the other spring is limited or entirely prevented. A valve connects the two compartments separated in the cylinder of each spring and may be operated by a mechanism separate from the valve operating mechanism of the other spring.

17 Claims, 8 Drawing Figures

CHAIR WITH PNEUMATICALLY ADJUSTABLE SEAT HEIGHT AND BACK SUPPORT INCLINATION

This invention relates to a chair whose seat height and back support inclination may be varied independently by controlling respective pneumatic springs, and particularly to a pneumatic spring assembly suitable for use in such a chair.

It is known to connect the base and the seat of a chair or stool by means of a pneumatic spring whose effective length can be varied by opening a passage between two compartments in a cylinder cavity of the spring separated by a piston, the base and seat being connected to the cylinder and piston rod of the spring respectively. It is also known to equip a tiltable back rest of a chair with a similarly adjustable spring. The known pneumatic spring arrangements are effective, but relatively complex and bulky, and assembling them with a chair is relatively costly.

It is a primary object of this invention to provide a pneumatic spring assembly that can be installed in a chair with minimal expense for labor to control the height and backrest inclination of the chair.

It is another object of the invention to provide a chair equipped with such a spring assembly.

With these and other objects in view, as will hereinafter become apparent, the invention provides a pneumatic spring assembly comprising first and second pneumatic springs which each include a cylinder whose cavity is axially separated into two compartments by a movable piston. A piston rod secured to the piston for joint axial movement axially projects from the cavity. A valve communicates with the two compartments and may be opened and closed by a manual operating mechanism. The second pneumatic spring is at least partly received in the cylinder or in the piston rod of the first pneumatic spring, and the piston rod or the cylinder of the second spring is connected to the receiving cylinder or piston rod of the first spring in such a manner that relative movement of the connected elements of the two springs is limited or prevented.

In another aspect, the invention resides in a chair equipped with the afore-described spring assembly whose base and seat carrier are respectively secured to the piston rod and the cylinder of the first spring. A supporting member is movably mounted on the carrier and connected to a movable member of the second spring for movement of the supporting member in response to axial movement of the piston in the cylinder cavity of the second spring.

Other features, additional objects, and many of the attendant advantages of this invention will readily be appreciated as the same becomes better understood by reference to the following detailed description of preferred embodiments when considered in connection with the appended drawing in which.

Figure 1:
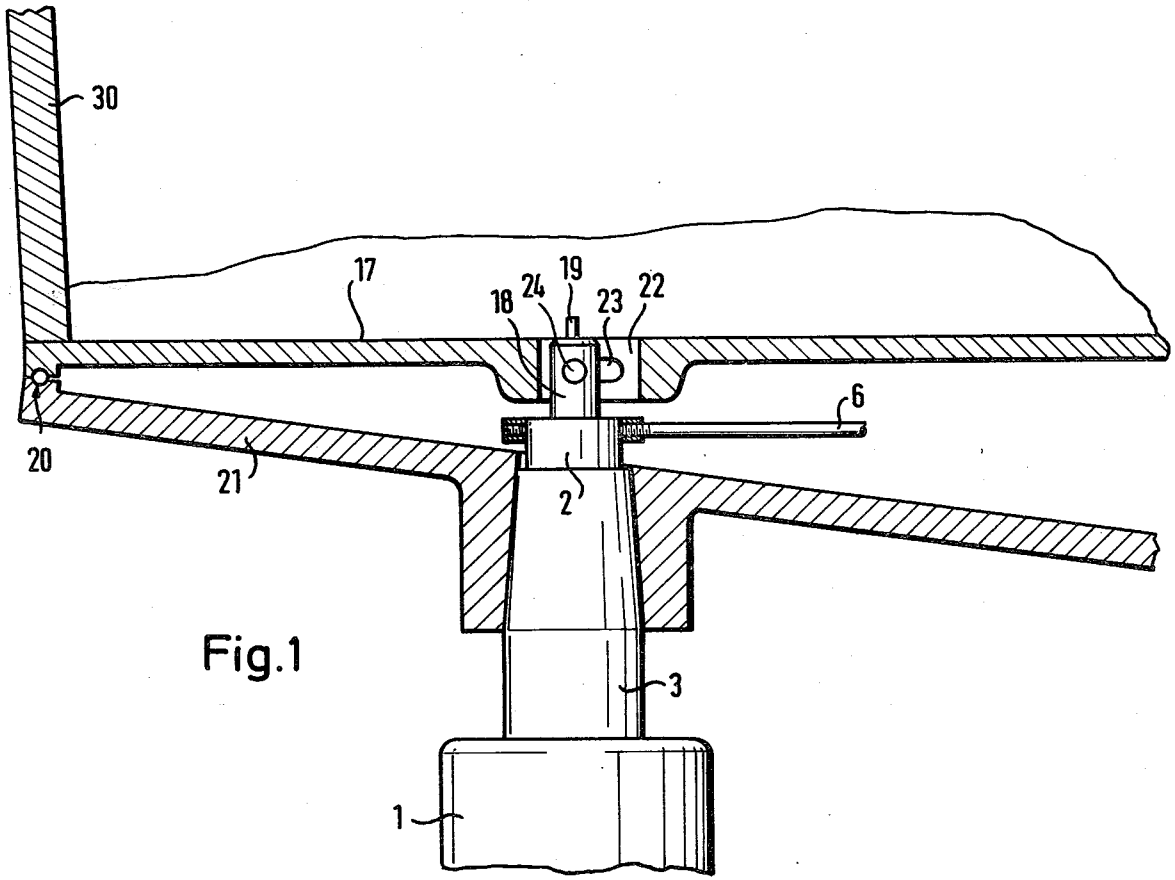
FIG. 1 shows a chair of the invention in fragmentary, side-elevational section.

Referring now to the drawing in detail, and initially to FIG. 1, there is shown only as much of a chair or stool of adjustable height as is needed for an understanding of certain aspects of the invention. The only leg of the chair is partly constituted by a pneumatic spring 1 whose externally visible portions are a cylinder, presently tubular or hollow piston rod 3 from which a second spring 2 projects. The axially terminal portion of the piston rod 3 visible in FIG. 1 tapers conically in an upward direction and is matingly received in a corresponding bore of a carrier plate 21. A bearing 20 on the carrier plate 21 provides a pivot for the seat of the chair of which only a flat base 17 for the seat cushion and a rigid member 30 of the back support are shown, the base 17 and member 30 being fixedly fastened to each other approximately at right angles near the bearing 20 about whose horizontal axis they may pivot jointly.

Such pivoting movement is controlled by the second spring 2 whose piston rod 18 is partly exposed and carries two opposite pins 24 parallel to the pivot axis of the bearing 20 and perpendicular to the common axis of the springs 1, 2. The piston rod 18 is received with ample clearance in an opening 22 of the base 17, and the pins 24 are slidably received in slots 23 of the base 17 transverse to the common axis of the springs and to the axis of the bearing 20. When the piston rod 18 is moved axially, the seat assembly is tilted on the bearing. Movement of the piston rod 18 is controlled by a valve operating mechanism, conventional in itself, and more fully illustrated in FIGS. 3 and 8, only a motion transmitting rod 19 of the mechanism being shown in FIG. 1. Vertical movement of the carrier plate 21 with the piston rod 3 is controlled by an operating arm 6 fixedly fastened to the second spring 2.

Figure 2:
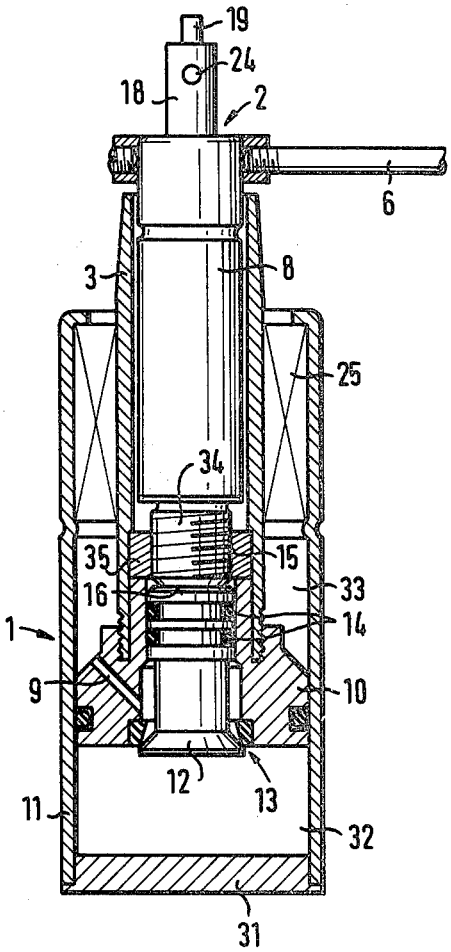
FIG. 2 illustrates the pneumatic spring assembly in the chair of FIG. 1 in elevational section.

As is better seen in FIG. 2, the piston rod 3 projects axially upward from the cylinder 11 of the first spring 1 through a packing 25. A piston 10 attached to the lower end of the piston rod 3 is axially movable in the cavity of the cylinder 11 in sealing engagement with the inner axial face of the cylinder and axially separates two compartments 32, 33 of the cylinder cavity which are filled with compressed air.

The cylinder 8 of the second spring 2 is movably received in the axial bore of the piston rod 3, and its radial bottom wall carries a fixed, coaxial extension 34 provided with helical, external threads 15 matingly engaged by corresponding threads in a guide ring 35 fixedly fastened between an internal shoulder of the piston rod 3 and the piston 10. A valve plunger 12 is axially movable in a bore of the piston 10 which extends from an annular valve seat 13 at the orifice of the bore in the compartment 32 to the radial end face 16 of the cylinder extension 34. An oblique bore 9 in the piston 10 connects the compartment 33 with the axial bore of the piston 10 immediately adjacent the valve seat 13, and sealing rings 14 on the valve plunger 12 prevent escape of compressed air from the compartment 33 toward the face 16. Air pressure in the compartment 32, downwardly bounded by a fixed end wall 31 of the cylinder 11, normally holds the plunger 12 in abutting engagement with the extension face 16.

In the illustrated position of the cylinder 8, the conically flaring lower end of the plunger 12 seals the opening in the valve seat 13, and is lifted from the valve seat when the cylinder extension 34 is turned in the threads 15 by means of the arm 6. When the valve 12, 13 is open, the air in the cylinder 11 tends to raise the piston rod 3 and the chair seat attached thereto, or the piston rod 3 may be pushed inward of the cylinder 11 to reduce the height of the chair, as is known in itself.

Figure 3:
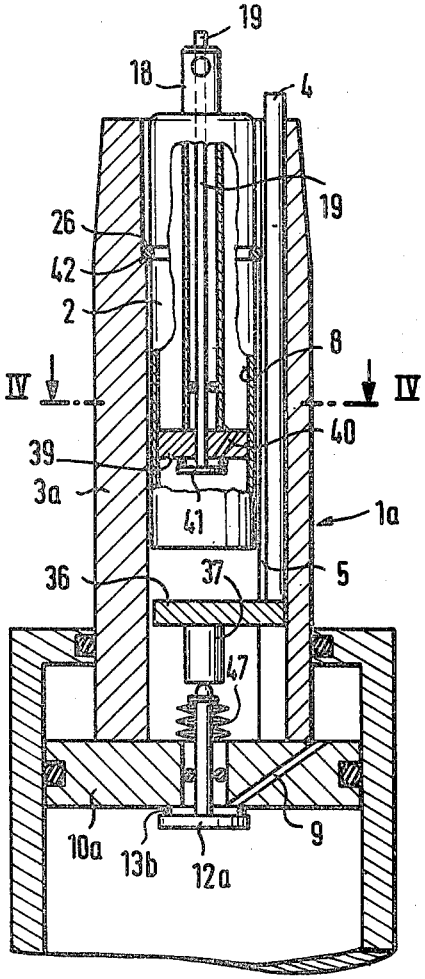
FIG. 3 shows another spring assembly for use in the chair of FIG. 1 in a corresponding view.
Figure 4:
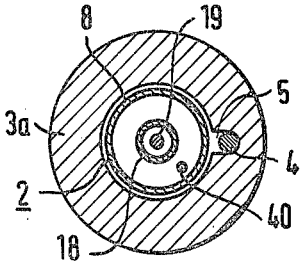
FIG. 4 shows elements of the spring assembly of FIG. 3 in plan section on the line IV — IV.

The internal structure of the second spring 2 is shown in FIG. 3 and FIG. 4 in a spring assembly having a different first spring 1*a* but the same second spring 2 as has been described in part with reference to FIGS. 1 and 2.

The piston rod 3*a* of the modified first spring 1*a* receives the cylinder 8 of the second spring, and the cavity of the latter is divided into two compartments by a piston 39, the compartments being filled with compressed air and capable of being connected through a passage 40 in the piston 39. The passage is normally sealed by a valve disk 41 in the lower compartment fixedly attached to the lower end of the afore-mentioned motion transmitting rod 19. The rod passes axially through aligned bores in the piston 39 and the piston rod 18, and is hermetically sealed in the bore of the piston rod.

Whereas axial movement of the cylinder 8 in the piston rod 3 shown in FIG. 2 is limited by the threaded engagement of the extension 34 with the guide ring 35, such axial movement is entirely prevented in the spring assembly of FIG. 3 by a retaining ring 26 partly received in the outer axial face of the cylinder 8 and abuttingly engaging a shoulder 42 in the bore of the piston rod 3*a*. The inclination of the carrier plate 21 and of the seat elements mounted thereon may thus be changed after the valve disk 41 has been lifted from the orifice of the passage 40 by means of the motion transmitting rod 19 and associated devices, conventional in themselves and more fully illustrated in FIG. 8.

The first spring 1*a* shown in FIGS. 3 and 4 is controlled by an axial push rod 4 movable in a groove 5 of the piston rod 3*a* which is radially open to the central bore of the piston rod, the push rod 4 thus being interposed between the outer axial face of the cylinder 8 and the inner axial face of the piston rod 3*a*. A bracket 36 at the lower end of the push rod 4 carries a plunger 37. A valve disk 12*a* normally is seated on a resilient ring 13*b* and blocks the lower orifices of a passage 9 in the piston 10*a* attached to the piston rod 3*a* and of a central, axial bore in the piston 10*a* in which the valve steam of the disk 12*a* passes upward into abutting engagement with the bottom face of the plunger 37 under the biasing force of a stack of cup springs 47.

To connect the two cylinder compartments normally separated by the piston 10*a*, the push rod 4 is moved axially downward by means of an operating lever of the type described hereinbelow with reference to FIG. 8, and the height of a chair only partly seen in FIG. 3 may then be adjusted, the tilt of the back support 30 being capable of analogous adjustment when the rod 19 opens the valve 41.

Figure 5:
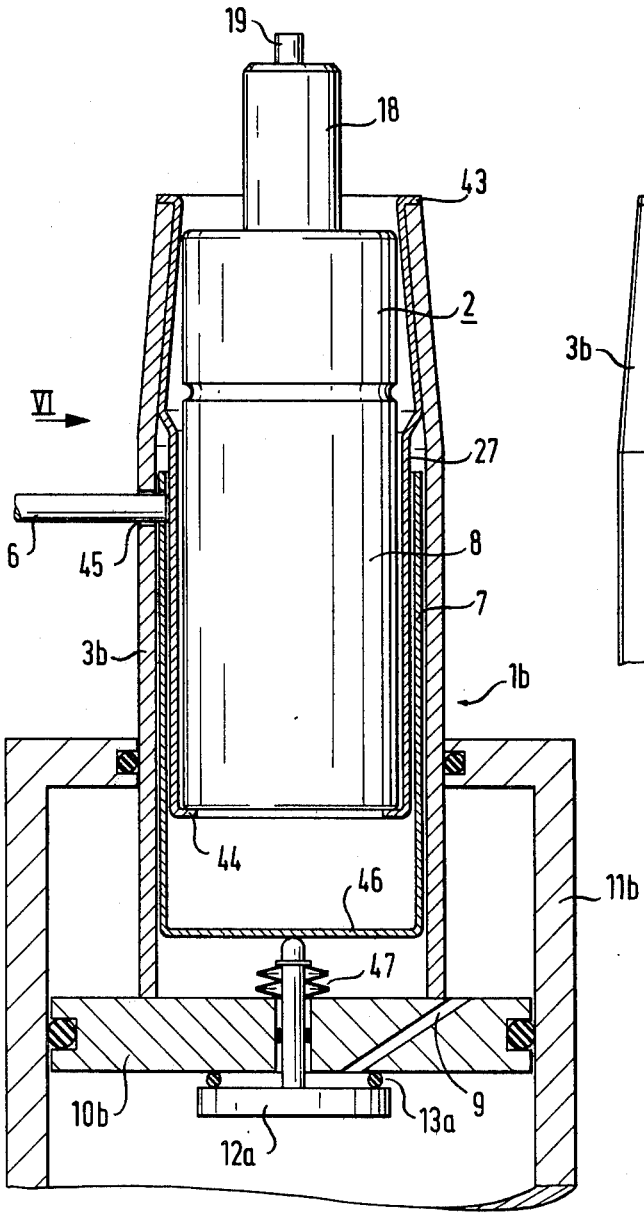
FIG. 5 shows an additional spring assembly for use in the chair of FIG. 1, the view corresponding to those of FIGS. 2 and 3.
Figure 6:
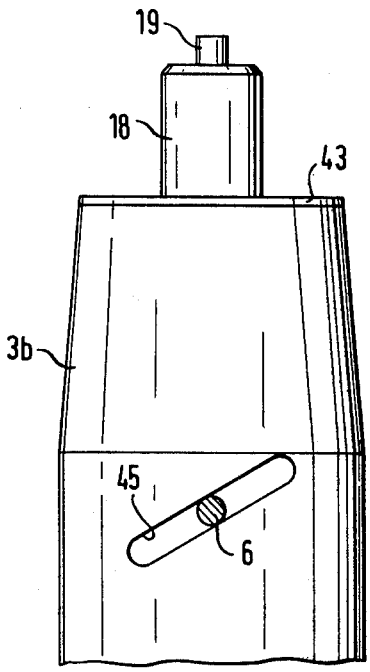
FIG. 6 illustrates the assembly of FIG. 5 in an elevational view taken in the direction of the arrow VI.

In the spring assembly partly shown in FIGS. 5 and 6, the second spring 2 is not significantly different from that described with reference to FIGS. 3 and 4. The first spring 1*b* has a hollow piston rod 3*b* whose lower end carries a piston 10*b* in the cavity of a cylinder 11*b*. The cylinder of the second spring 2 is suspended in the bore of the piston rod 3*b* by means of a coaxial sleeve 27 interposed between the inner axial face of the piston rod 3*b* and the outer axial face of the cylinder 8. An outer radial flange 43 on the top end of the sleeve 27 engages an annular end face of the piston rod 3*b* and secures the sleeve against axial movement inward of the piston rod 3*b*. An inner radial flange 44 at the bottom end of the sleeve 27 abuttingly supports the cylinder 8. The top portion of the sleeve 27 conformingly engages the conically tapering inner wall portion of the piston rod 3*b* and thereby prevents axial upward movement of the cylinder 8.

The lower portion of the sleeve 27 is radially offset from the piston rod 3*b* sufficiently to provide space for the cylindrical portion of a cup-shaped motion-transmitting member 7 of sheet metal. A slot 45 in the piston rod 3*b* is obliquely inclined relative to the common axis of the two springs and guides an operating arm 6 fixedly fastened to the member 7. When the arm 6 is moved manually in the slot 45, the bottom wall 46 of the member 7 depresses the stem of a poppet valve 12*a* against the restrainst of a stack of cup springs 47 to lift the valve from its seat 13*a*, and thereby to permit passage of fluid between the compartments of the cylinder 11*b* through a passage 9 in the piston 10*b*.

Figure 7:
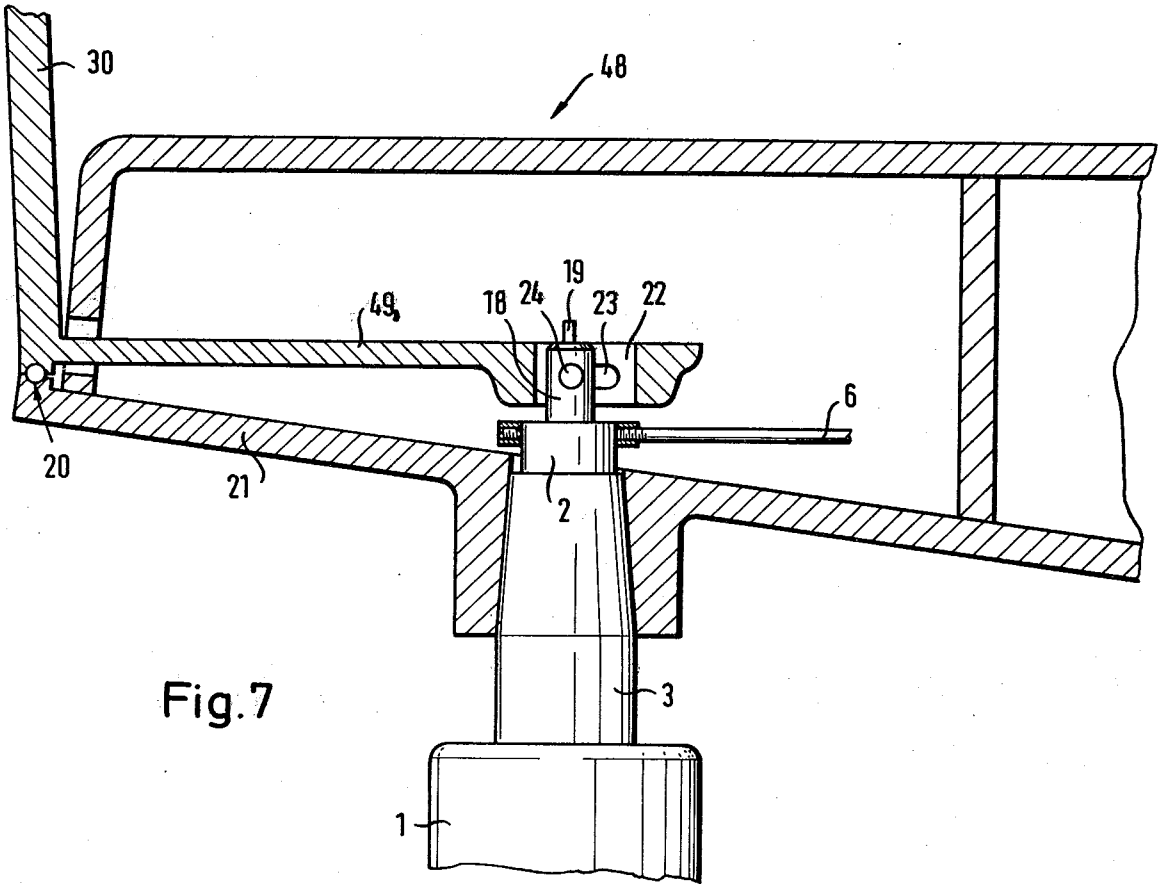
FIG. 7 shows another chair of the invention suitable for being equipped with the spring assemblies of FIGS. 2 to 6 in a view corresponding to that of FIG. 1.

Each of the spring assemblies described so far and the spring assembly yet to be described with reference to FIG. 8 may be used in the manner shown in FIG. 1 in combination with a carrier plate 21 on which a chair seat, including a base 17 and a rigid back support member 30 are jointly pivotable on a bearing 20. The spring assemblies, however, may also be used in the manner illustrated in FIG. 7 in which the base 48 for the seat cushion, not itself shown, is fixedly attached to the carrier 21, and the back support member 30 is pivotally secured to the carrier plate 21 by the bearing 20. Motion is transmitted from the piston rod 18 of the second spring 2 to the back rest member 30 by an arm 49 fixedly fastened to the back rest member 30 and provided with an opening 22 and slots 23 for receiving the piston rod 18 and the transverse pins 24 respectively, as described with reference to FIG. 1.

As is known in itself, the back rest member 30 may be coupled with a non-illustrated leg rest normally depending from the front edge of the base 48 in such a manner that the leg rest is tilted upward toward a horizontal position when the seat back member 7 is tilted downward a similar position. Alternatively, the back rest may be adjusted in a different manner, and only the leg rest controlled by the second spring 2 in a manner obvious from the showing of FIG. 7.

The cylinder and piston rod of each pneumatic spring of the general type disclosed jointly determine the effective length of the spring, and springs may be installed in an axially vertical position with the piston rod either up or down, and the cylinder correspondingly directed downward or upward. Known modifications of the illustrated compartment-connecting valve arrangements permit a valve actuating member to enter the spring either from the cylinder end or the piston rod end. The spring assemblies described so far respresent only one of the four basic combinations of piston rod and cylinder positions interchangeably available in the spring assembly of the invention.

Figure 8:
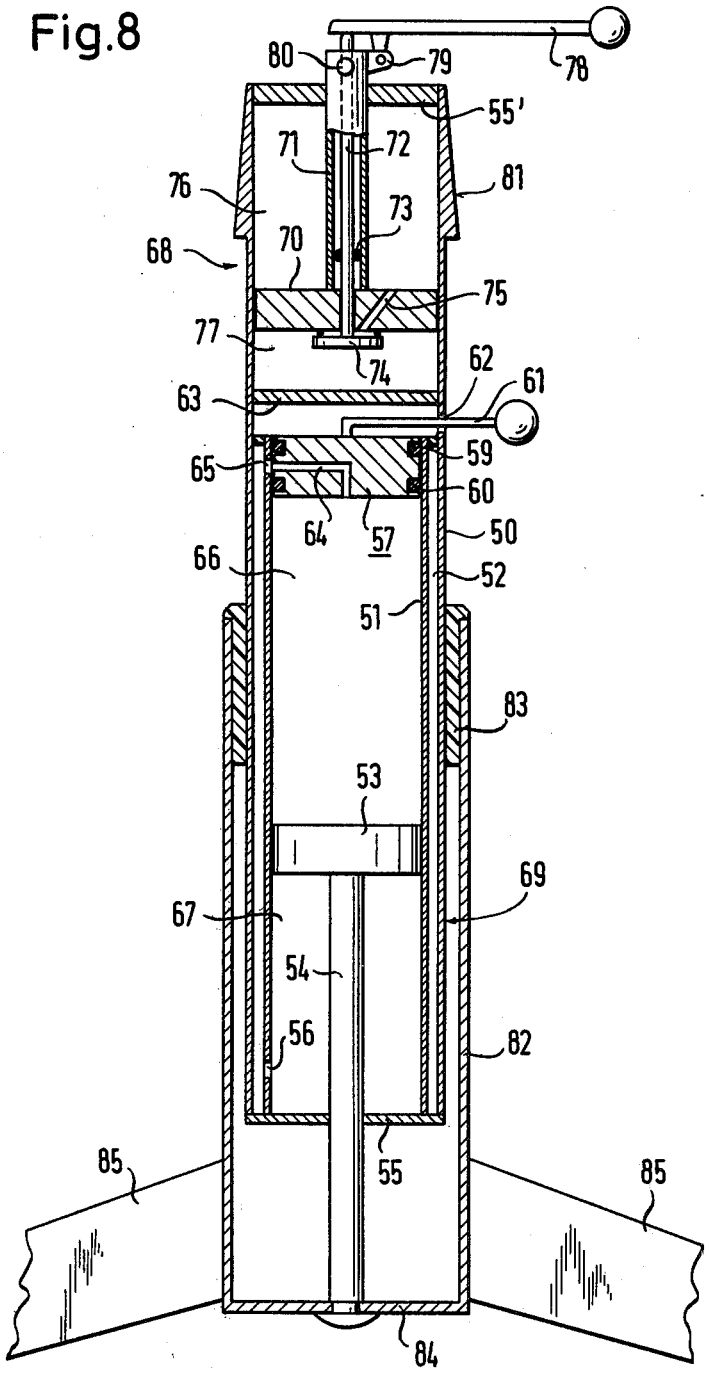
FIG. 8 illustrates yet another spring assembly and chair base for use with chair elements seen in FIGS. 1 and 7.

One of the other three basic combinations is illustrated in FIG. 8 in which the relative position of piston and cylinder in the height-controlling spring is reversed. An upper, axial portion of a cylindrical tube 50 constitutes the cylinder of a pneumatic spring 68 while the lower axial portion spacedly and coaxially envelopes another cylindrical tube 51, a duct 52 of annular cross section being radially bounded by the tubes 50, 51. The tube 51 is the cylinder of another pneumatic spring 69 which is divided into two compartments 66, 67 by a piston 53. A piston rod 54 passes axially outward of the lower compartment 67 through the common radial bottom wall 55 of the compartment 67 and of the duct 52.

The upper end of the duct 52 is sealed, and the tube 51 has radial bores 65, 56 therethrough near the upper and lower ends of the duct 52. The compartment 66 is normally sealed in an axially upward direction by a rotary valve plug 57 and by sealing rings 59, 60 interposed between the plug and the inner wall of the tube 51 which also axially secure the plug 57. In the illustrated angular position of the plug, a bore 64 in the plug 57 is aligned with the radial bore 65 so that compressed air may flow between the compartments 66, 67 through the bores 56, 65 and the duct 51. The plug 57 may be turned manually from its illustrated open position about the common axis of the tubes 50, 51 by means of a radial operating arm 61 passing outward of the tube 50 through a circumferentially elongated slot 62 between the plug 57 and a partition 63 which seals a lower cylinder compartment 77 of the spring 68 in a downward axial direction.

The upper cylinder compartment 76 extends between an annular end wall 55' and a piston 70 from which a tubular piston rod 71 extends axially upward through the end wall 55' in sealing engagement. An actuating rod 72 coaxially passes through the bore of the piston rod 71 and an aligned, central, axial bore in the piston 70. A valve disk 74 is attached to the rod 72 in the lower cylinder compartment 77 and normally seals the orifices of the central bore of the piston 70 and of a bore 75 which leads to the upper compartment 76. A sealing ring 73 in the bore of the piston rod 71 prevents the escape of compressed air along the actuating rod 72. A bracket 79 on the piston rod 71 outside the cylinder cavity of the spring 68 pivotally carries an operating lever 78 whose short arm pushes the rod 72 downward to lift the valve disk 74 from the orifices in the piston 70 in the compartment 77 when the long arm of the lever 78 is raised manually. A conical, external enlargement 81 on the top end of the tube 50 fits the opening in the carrier plate 21 shown in FIGS. 1 and 7, and transverse pins 80 on the piston rod 71 engage the slots 22 of the base 17 or of the arm 49 when the spring assembly of FIG. 8 is installed in a chair of the invention.

The outer tube 50 together with all other elements described so far with reference to FIG. 8 is mounted for coaxial sliding movement in a cup-shaped column 82 by means of a plastic guide sleeve 83. The outer end of the piston rod 54 is fixedly fastened to the bottom wall 84 of the column 82, and three feet 85 extend radially outward and downward from the column 82 for engagement with a floor on which the partly illustrated chair stands. While not so illustrated, it will be understood that feet 85 similarly extend from the cylinder 11 in FIG. 2 and from analogous elements in FIGS. 2, 3, and 5. The effective length of the spring assembly shown in FIG. 8 is controlled by the arm 61, and the angular position of a back rest member 30, not itself seen in FIG. 8, is controlled by the lever 78 when the spring assembly of FIG. 8 is installed in a chair in the manner shown in FIG. 1 or 7.

While the invention has been described with specific reference to a chair or stool, the spring assemblies of the invention may be employed in other systems in which three components need to be moved relative to each other, the column 82, carrier plate 21, and back rest member 30 being merely representative of such components.

It should be understood, therefore, that the foregoing disclosure relates only to preferred embodiments of the invention, and that it is intended to cover all changes and modifications in the examples of the invention herein chosen for the purpose of the disclosure which do not constitute departures from the spirit and scope of the invention set forth in the appended claims.

What is claimed is:

1. A pneumatic spring assembly comprising:

a. a first pneumatic spring including a first cylinder portion having an axis and defining a first cavity therein, a first piston axially movable in said cavity and axially separating two compartments of said cavity, a first piston rod portion secured to said piston for joint axial movement and axially projecting from said cavity, a gas under a pressure higher than atmospheric pressure filling said compartments, first valve means connecting said compartments, and first manually operable means for opening and closing said valve means and for thereby controlling flow of said gas between said compartments;

b. a second pneumatic spring including a second cylinder portion having an axis and defining a second cavity therein, a second piston axially movable in said second cavity and axially separating two compartments of said second cavity, a second piston rod portion secured to said second piston for joint axial movement and axially projecting from said second cavity, a gas under a pressure higher than atmospheric pressure filling said compartments of said second cavity, second valve means connecting said compartments of said second cavity for controlling flow of said gas therebetween, and second manually operable means for opening and closing said second valve means while said first valve means are open and while said first valve means are closed, 1. one of said portions of said second pneumatic spring being received in one of said portions of said first pneumatic spring; and c. securing means connecting said one portion of said second pneumatic spring to said one portion of said first pneumatic spring and limiting relative axial movement of the connected portions.

2. An assembly as set forth in claim 1, wherein each of said cylinder portions includes a cylinder member, and each of said piston rod portions includes a piston rod member, one of said members of said first pneumatic spring being hollow and receiving therein one of the members of said second pneumatic spring.

3. An assembly as set forth in claim 1, wherein the axes of said cylinder portions substantially coincide.

4. An assembly as set forth in claim 1, wherein said first piston rod portion is hollow and receives said one portion of said second pneumatic spring, said first piston being formed with a passage extending axially therethrough, said first valve means including a valve member movable on said first piston toward and away from a position in which said valve member blocks said passage, and said first manually operable means including a motion transmitting member axially movable in said hollow first piston rod portion and operatively connected to said valve member.

5. An assembly as set forth in claim 4, wherein said first piston rod portion has an internal axial face and said second cylinder portion has an external axial face, said motion transmitting member being radially interposed between said faces.

6. An assembly as set forth in claim 5, wherein said motion transmitting member is tubular.

7. An assembly as set forth in claim 6, wherein said securing means include a sleeve member having two axially terminal portions remote from and adjacent said first piston respectively, the axially terminal portion remote from said first piston being secured to said first piston rod portion, and the other axially terminal portion engaging said second cylinder portion in axial abutment, said tubular motion transmitting member being radially interposed between said internal axial face of the first piston rod portion and said sleeve member.

8. An assembly as set forth in claim 7, wherein said first piston rod portion is formed with an opening extending radially therethrough, said first manually operable means further including an operating member secured to said tubular motion transmitting member for joint for joint movement and passing through said opening.

9. An assembly as set forth in claim 8, wherein said opening is elongated at an oblique angle relative to the axis of said first cylinder portion.

10. An assembly as set forth in claim 4, wherein said motion transmitting member is fixedly fastened to said second cylinder portion.

11. An assembly as set forth in claim 10, wherein said securing means include helical guide means securing said second cylinder portion to said first piston rod portion for limited axial movement and simultaneous angular movement about one of said axes.

12. An assembly as set forth in claim 11, wherein said first manually operable means further include an operating member secured to said second cylinder portion for actuating said axial and simultaneous angular movements of said second cylinder portion.

13. A chair of adjustable height comprising:

a. a gas spring assembly as set forth in claim 1;

b. a base secured to one of said portion of said first pneumatic spring;

c. a carrier member secured to the other portion of said first pneumatic spring for joint axial movement relative to said one portion;

d. a supporting member movably mounted on said carrier member; and e. motion transmitting means connecting said supporting member to the other portion of said second pneumatic spring for moving said supporting member relative to said carrier member in response to axial movement of said second piston in said second cavity.

14. A chair as set forth in claim 13, further comprising pivot means connecting said supporting member to said carrier member for pivoting movement by said motion transmitting means about a pivot axis transverse to said axes of said first and second cylinder portion.

15. A chair as set forth in claim 14, further comprising a seat assembly secured to said supporting member for joint pivoting movement.

16. A chair as set forth in claim 14, further comprising a seat assembly secured to said carrier member for pivotal movement of said supporting member relative to said seat assembly by said motion transmitting means.

17. An assembly comprising:

a. a first pneumatic spring including a first cylinder member having an axis and defining a first cavity therein, a first piston axially movable in said cavity and axially separating two compartments of said cavity, a first piston rod member secured to said piston for joint axial movement and axially projecting from said cavity, first valve means communicating with said compartments, and first manually operable means for opening and closing said valve means;

b. a second pneumatic spring including a second cylinder member having an axis and defining a second cavity therein, a second piston axially movable in said second cavity and axially separating two compartments of said second cavity, a second piston rod member secured to said second piston for joint axial movement and axially projecting from said second cavity, second valve means communicating with said compartments of said second cavity, and second manually operable means for opening and closing said second valve means, 1. said second pneumatic spring being received in one of said members of said first pneumatic spring;

c. securing means connecting one of said members of said second pneumatic spring to said one member of said first pneumatic spring and limiting relative axial movement of the connected members;

d. a base secured to one of said members of said first pneumatic spring;

e. a carrier member secured to the other member of said first pneumatic spring for joint axial movement relative to said one member;

f. a supporting member movably mounted on said carrier member; and g. motion transmitting means connecting said supporting member to the other member of said second pneumatic spring for moving said supporting member relative to said carrier member in response to axial movement of said second piston in said second cavity.

* * * * *